US006082662A

United States Patent [19]

Gallien

[11] Patent Number: 6,082,662

[45] Date of Patent: Jul. 4, 2000

[54] WALLPAPER DISPENSER

[76] Inventor: Joseph T. Gallien, 20111 Rustlewood St., Humble, Tex. 77338

[21] Appl. No.: 09/190,577

[22] Filed: Nov. 12, 1998

[51] Int. Cl.[7] ..... B65D 85/02

[52] U.S. Cl. ..... 242/588.6; 206/409; 225/9; 225/17; 225/43; 225/89; 242/563.2; 242/571.5

[58] Field of Search ..... 242/588.6, 588.3, 242/571, 571.5, 563.2, 598.2; 206/409; 225/9, 17, 39, 43, 46, 47, 89

[56] References Cited

U.S. PATENT DOCUMENTS

| | | | |
|---|---|---|---|
| 996,530 | 6/1911 | Seeley et al. | 242/571 X |
| 1,055,409 | 3/1913 | McMillin | 242/598.2 X |
| 2,248,716 | 7/1941 | Markle, Jr. | 242/571.5 X |
| 2,381,229 | 8/1945 | Shalhoub | 225/47 |
| 3,456,854 | 7/1969 | Condy . | |
| 3,851,809 | 12/1974 | McKibbin | 225/89 X |
| 4,098,916 | 7/1978 | Ruthart et al. . | |
| 4,417,495 | 11/1983 | Gordon et al. . | |
| 4,451,010 | 5/1984 | Meyer | 242/588.3 X |
| 5,050,529 | 9/1991 | Pardee . | |
| 5,277,351 | 1/1994 | McCullagh | 225/47 X |
| 5,538,200 | 7/1996 | Tatum | 242/598.2 X |

*Primary Examiner*—Donald P. Walsh
*Assistant Examiner*—William A. Rivera

[57] ABSTRACT

A wallpaper dispenser including a housing and a wallpaper roll holder rotatably mounted within the housing for releasably and fixedly receiving a roll of wallpaper thereon. A counter is mounted on the housing and connected to the wallpaper roll holder.

7 Claims, 2 Drawing Sheets

WALLPAPER DISPENSER

BACKGROUND OF THE INVENTION

1. Field of the Invention

The present invention relates to paper product dispensers and more particularly pertains to a new wallpaper dispenser for dispensing and measuring wallpaper in a convenient manner.

2. Description of the Prior Art

The use of paper product dispensers is known in the prior art. More specifically, paper product dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,098,916; U.S. Pat. No. 5,050,529; U.S. Pat. No. 5,249,547; U.S. Pat. No. 5,336,323; U.S. Pat. No. 3,647,078; and U.S. Pat. Des. 335,985.

In these respects, the wallpaper dispenser according to the present invention substantially departs from the conventional concepts and designs of the prior art, and in so doing provides an apparatus primarily developed for the purpose of dispensing and measuring wallpaper in a convenient manner.

SUMMARY OF THE INVENTION

In view of the foregoing disadvantages inherent in the known types of paper product dispensers now present in the prior art, the present invention provides a new wallpaper dispenser construction wherein the same can be utilized for dispensing and measuring wallpaper in a convenient manner.

The general purpose of the present invention, which will be described subsequently in greater detail, is to provide a new wallpaper dispenser apparatus and method which has many of the advantages of the paper product dispensers mentioned heretofore and many novel features that result in a new wallpaper dispenser which is not anticipated, rendered obvious, suggested, or even implied by any of the prior art paper product dispensers, either alone or in any combination thereof.

To attain this, the present invention generally comprises a housing with a generally rectangular configuration. As shown in the Figures, the housing includes an elongated rectangular bottom face, an elongated rectangular rear face, an elongated rectangular front face, and a pair of short square side faces coupled therebetween. Ideally, the side faces extend upwardly beyond the front face and the rear face to define a front recess and a rear recess. Next provided is a wallpaper roll holder including a cylindrical rod. Such rod has a first end pivotally coupled to a first one of the side faces of the housing via a universal joint. A radially extending retainer flange is mounted on the rod adjacent the universal joint, as shown in FIG. 2. The rod of the wallpaper roll holder further has a second end with a cap. This cap includes an inboard end with a bore adapted for removably receiving a dowel formed on the rod. A radially extending retainer flange is mounted on the cap adjacent an outboard end of the cap. Further, a pivot tab is mounted on the outboard end of the cap and is adapted for being removably and rotatably received within a recess formed in a second one of the side faces of the housing. The cylindrical rod of the wallpaper roll holder further includes a plurality of resilient arcuate members each having a pair of ends coupled to opposite ends of the cylindrical rod. As shown in FIG. 2, the resilient arcuate members are bowed outwardly along a central extent thereof for maintaining a roll of wallpaper thereon in fixed relationship therewith. Mounted within the first side face of the housing is a counter which is connected to the universal joint of the wallpaper roll holder. In use, the counter is adapted for tracking a number of rotations of the rod of the wallpaper roll holder. From such calculation, a length of the wallpaper that is dispensed is calculated. For displaying a current length of the dispensed wallpaper, a display is mounted on a top edge of the first side face of the housing. Associated therewith is a reset button mounted on the top edge of the first side face of the housing for calculating from zero the length of the dispensed wallpaper upon the depression thereof. Finally, a lid is provided including a top face with a size and shape similar to that of the bottom face of the housing. The top face of the lid has a pair of downwardly extending lips coupled to elongated edges thereof. A first one of the downwardly extending lips is hingably coupled to one of the recesses of the housing for allowing selective access to an interior of the housing. As best shown in FIGS. 1, 2, & 4, the top face of the lid has a slot formed therein adjacent to a second downwardly extending lip thereof. Ideally, the slot is defined by a pair of forwardly beveled edges. Formed in a rearmost edge of the slot is a horizontally oriented recess which resides between an upper surface and a lower surface of the top face of the lid. As shown in FIG. 4, a holder strip with a frontmost beveled edge is slidably mounted within the recess between a first orientation for allowing the wallpaper to be dispensed therethrough and a second orientation to preclude the wallpaper from being dispensed therethrough. In the second orientation, the wallpaper may be cut. Lastly, a gripping knob is connected to a central extent of the holder strip for sliding the same between the first and the second orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wallpaper dispenser apparatus and method which has many of the advantages of the paper product dispensers mentioned heretofore and many novel features that result in a new wallpaper dispenser which is not anticipated, rendered obvious, suggested, or even implied by any of the prior art paper product dispensers, either alone or in any combination thereof.

It is another object of the present invention to provide a new wallpaper dispenser which may be easily and efficiently manufactured and marketed.

It is a further object of the present invention to provide a new wallpaper dispenser which is of a durable and reliable construction.

An even further object of the present invention is to provide a new wallpaper dispenser which is susceptible of a low cost of manufacture with regard to both materials and labor, and which accordingly is then susceptible of low prices of sale to the consuming public, thereby making such wallpaper dispenser economically available to the buying public.

Still yet another object of the present invention is to provide a new wallpaper dispenser which provides in the apparatuses and methods of the prior art some of the advantages thereof, while simultaneously overcoming some of the disadvantages normally associated therewith.

Still another object of the present invention is to provide a new wallpaper dispenser for dispensing and measuring wallpaper in a convenient manner.

Even still another object of the present invention is to provide a new wallpaper dispenser that includes a housing and a wallpaper roll holder rotatably mounted within the housing for releasably and fixedly receiving a roll of wallpaper thereon. A counter is mounted on the housing and connected to the wallpaper roll holder. In use, the counter is adapted to calculate a length of wallpaper dispensed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
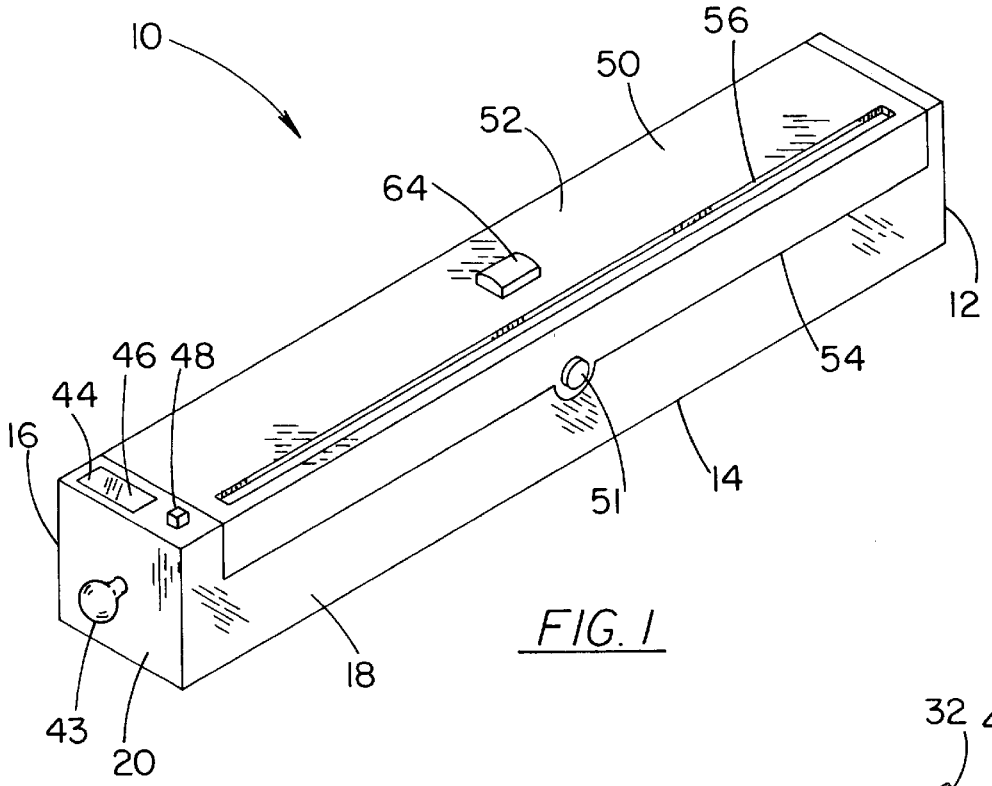
FIG. 1 is a perspective view of a new wallpaper dispenser according to the present invention.

With reference now to the drawings, and in particular to FIGS. 1 through 4 thereof, a new wallpaper dispenser embodying the principles and concepts of the present invention and generally designated by the reference numeral 10 will be described.

The present invention, designated as numeral 10, includes a housing 12 with a generally rectangular configuration. As shown in the Figures, the housing includes an elongated rectangular bottom face 14, an elongated rectangular rear face 16, an elongated rectangular front face 18, and a pair of short square side faces 20 coupled therebetween. Ideally, the side faces extend upwardly beyond the front face and the rear face to define a rear recess and a front recess 22.

Figure 2:
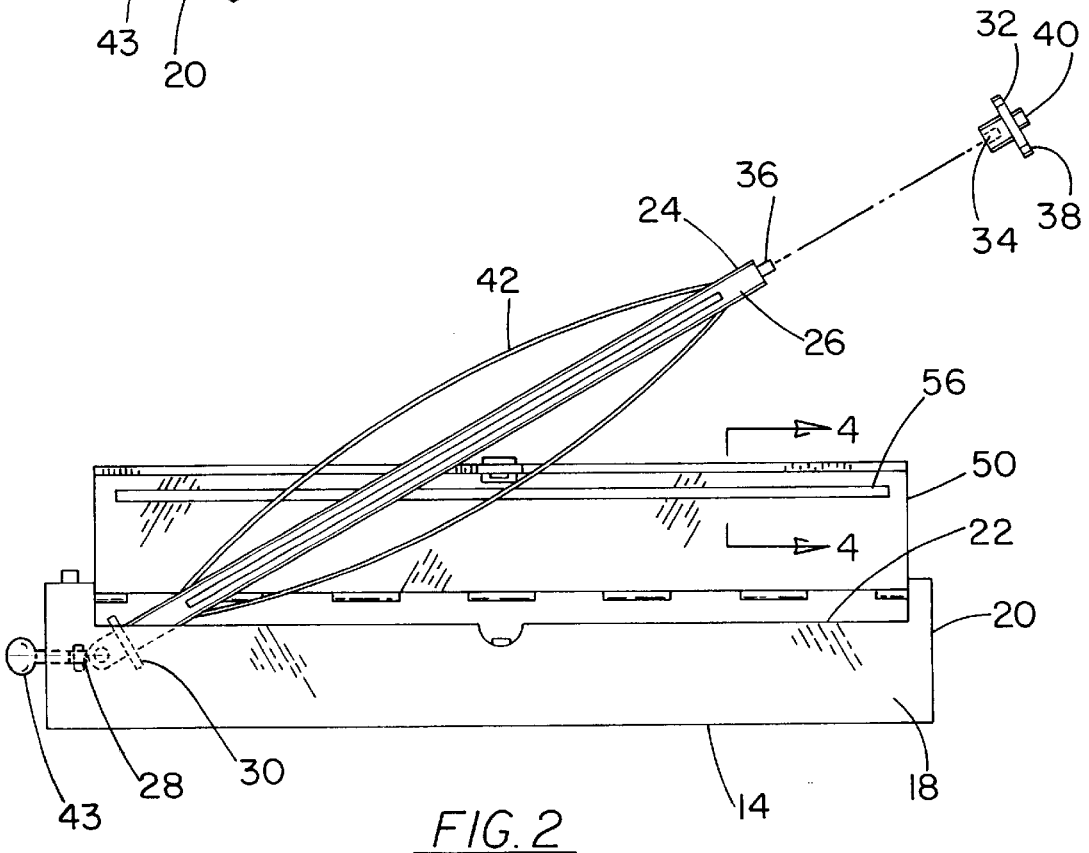
FIG. 2 is a front view of the present invention with the lid open and the wallpaper roll holder raised.
Figure 3:
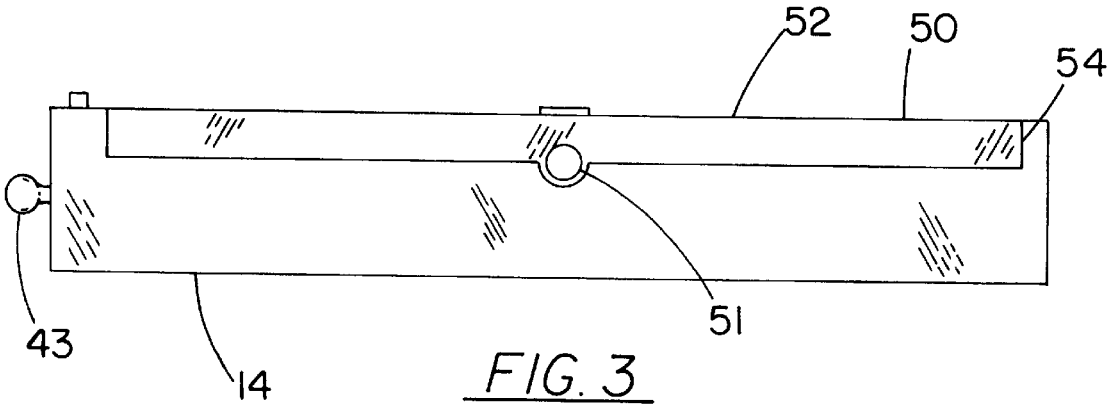
FIG. 3 is a front view of the present invention.

Next provided is a wallpaper roll holder 24 including a cylindrical rod 26. Such rod has a first end pivotally coupled to a first one of the side faces of the housing via a universal joint 28. The rod may thus be rotated about a horizontal axis aligned with the rod and further rotated about a traverse axis for loading purposes. A radially extending retainer flange 30 is mounted on the rod adjacent the universal joint, as shown in FIG. 2. The rod of the wallpaper roll holder further has a second end with a cap 32. This cap includes an inboard end with a bore 34 adapted for removably receiving a dowel 36 formed on the rod. A radially extending retainer flange 38 is mounted on the cap adjacent an outboard end of the cap. Further, a pivot tab 40 is mounted on the outboard end of the cap and is adapted for being removably and rotatably received within a recess formed in a second one of the side faces of the housing.

The cylindrical rod of the wallpaper roll holder further includes a plurality of resilient arcuate members 42 each having a pair of ends coupled to opposite ends of the cylindrical rod. As shown in FIG. 2, the resilient arcuate members are bowed outwardly along a central extent thereof for maintaining the roll of wallpaper thereon in fixed relationship therewith. As an option, an external rotating knob 43 with a spherical head may be fixed to the rod of the wallpaper roller holder via the universal joint in order to manually rotate the rod.

Mounted within the first side face of the housing is a counter 44 which is connected to the universal joint of the wallpaper roll holder. In use, the counter is adapted for tracking a number of rotations of the rod of the wallpaper roll holder. From such calculation, a length of the wallpaper that is dispensed is calculated. Ideally, this calculation either assumes an average diameter or circumference of the roll of wallpaper or, in the alternative, incorporates a reducing factor to take into account the fact that the diameter or circumference of the wallpaper roll is decreasing when the wallpaper is being dispensed. For displaying a current length of the dispensed wallpaper, a display 46 is mounted on a top edge of the first side face of the housing. Associated therewith is a reset button 48 mounted on the top edge of the first side face of the housing for calculating the length of the dispensed wallpaper from zero upon the depression thereof.

Finally, a lid 50 is provided including a top face 52 with a size and shape similar to that of the bottom face of the housing. The top face of the lid has a pair of downwardly extending lips 54 coupled to elongated edges thereof. A first one of the downwardly extending lips is hingably coupled to one of the recesses of the housing for allowing selective access to an interior of the housing. As an option, a locking latch 51 may be positioned on a semicircular extension of a second one of the downwardly extending lips. This latch may be received by an indent formed in the front face of the housing, as shown in FIGS. 1 & 2. As such, the lid may be selectively locked.

Figure 4:
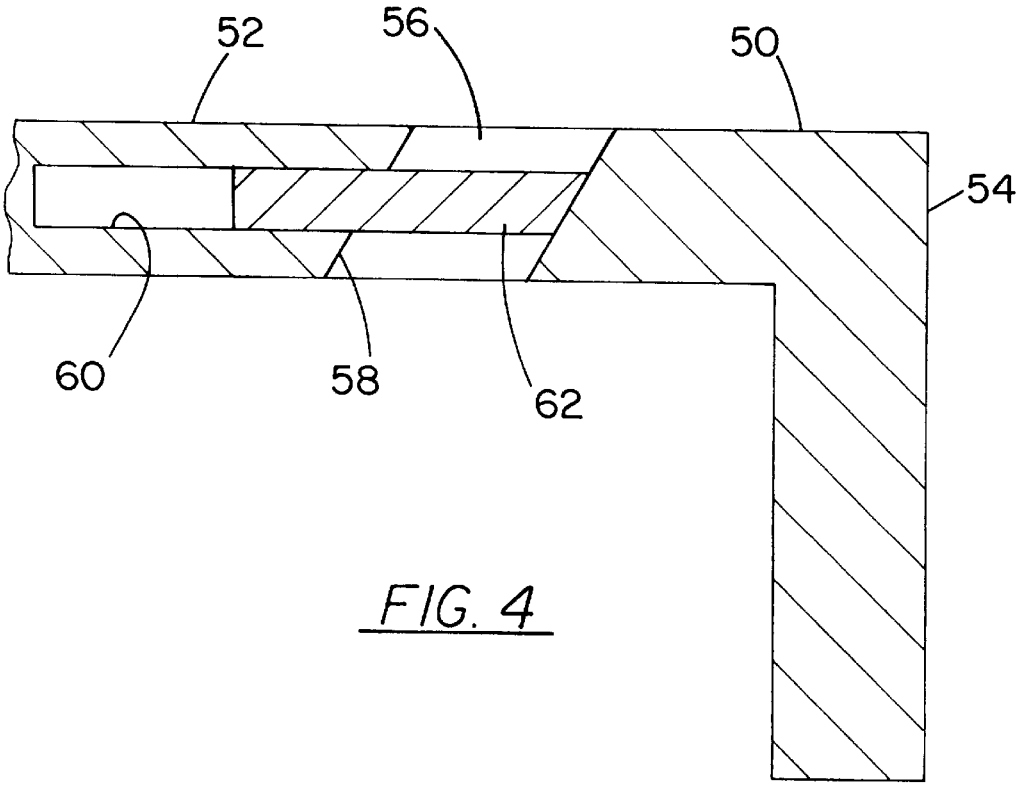
FIG. 4 is a side cross-sectional view of the present invention taken along line 4—4 shown in FIG. 2.

As best shown in FIGS. 1, 2, & 4, the top face of the lid has a slot 56 formed therein adjacent to a second downwardly extending lip thereof. Ideally, the slot is defined by a pair of forwardly beveled edges 58. Formed in a rearmost edge of the slot is a horizontally oriented recess 60 which resides between an upper surface and a lower surface of the top face of the lid. As shown in FIG. 4, a holder strip 62 with a frontmost beveled edge is slidably mounted within the recess between a first orientation for allowing the wallpaper to be dispensed therethrough and a second orientation to preclude the wallpaper from being dispensed therethrough. In the second orientation, the wallpaper may be cut or torn along the beveled edge of the holder strip. Lastly, a gripping knob 64 is connected to a central extent of the holder strip for sliding the same between the first and the second orientation. The gripping knob ideally extends through an unillustrated slit formed in the upper surface of the top face of the lid. Note FIG. 1.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wallpaper dispenser comprising, in combination:

a housing with a generally rectangular configuration including an elongated rectangular bottom face, an elongated rectangular rear face, an elongated rectangular front face, and a pair of short square side faces coupled therebetween and extending upwardly beyond the front face and the rear face to define a front recess and a rear recess;

a wallpaper roll holder including a cylindrical rod having a first end pivotally coupled to a first one of the side faces of the housing via a universal joint with a radially extending retainer flange mounted on the rod adjacent the universal joint, the rod of the wallpaper roll holder further having a second end with a cap including an inboard end with a bore adapted for removably receiving a dowel formed on the rod, a radially extending retainer flange mounted on the cap adjacent an outboard end of the cap, and a pivot tab mounted on the outboard end of the cap which is adapted for being removably and rotatably received within a recess formed in a second one of the side faces of the housing, the cylindrical rod of the wallpaper roll holder further including a plurality of resilient arcuate members each having a pair of ends coupled to opposite ends of the cylindrical rod and being bowed outwardly along a central extent thereof for maintaining a roll of wallpaper thereon in fixed relationship therewith;

a counter mounted within the first side face of the housing and connected to the universal joint of the wallpaper roll holder for tracking a number of rotations of the rod of the wallpaper roll holder and calculating therefrom a length of the wallpaper that is dispensed, a display mounted on a top edge of the first side face of the housing for displaying a current length of the dispensed wallpaper, and a reset button mounted on the top edge of the first side face of the housing for calculating from zero the length of the dispensed wallpaper upon the depression thereof; and a lid including a top face with a size and shape similar to that of the bottom face of the housing and a pair of downwardly extending lips coupled to elongated edges of the top face, a first one of the downwardly extending lips being hingably coupled to one of the recesses of the housing for allowing selective access to an interior of the housing, the top face of the lid having a slot formed therein adjacent to a second downwardly extending lip thereof and defined by a pair of forwardly beveled edges, a horizontally oriented recess formed in a rearmost edge of the slot between an upper surface and a lower surface of the top face of the lid, a holder strip with a frontmost beveled edge slidably mounted within the recess between a first orientation for allowing the wallpaper to be dispensed therethrough and a second orientation to preclude the wallpaper from being dispensed therethrough such that the second orientation prevents the wallpaper from moving while cutting to ensure a straight cut, and a gripping knob connected to a central extent of the holder strip for sliding the same between the first and the second orientation.

2. A wallpaper dispenser comprising:

a housing;

a wallpaper roll holder rotatably mounted within the housing and adapted for releasably and fixedly receiving a roll of wallpaper thereon;

a counter mounted on the housing and connected to the wallpaper roll holder and adapted to calculate a length of wallpaper dispensed; and wherein the housing includes a lid pivotally coupled thereto with a slot formed therein for dispensing the wallpaper, the lid having a holder strip slidably coupled thereto for selectively precluding the dispensing of the wallpaper such that the second orientation prevents the wallpaper from moving while cutting the wallpaper to ensure a straight cut.

3. A wallpaper dispenser as set forth in claim 2 wherein the wallpaper roll holder includes a rod with a plurality of resilient arcuate members having ends mounted to opposite ends of the rod and bowed outwardly at a central extent thereof.

4. A wallpaper dispenser as set forth in claim 2 wherein the counter includes a display for displaying the calculated length.

5. A wallpaper dispenser as set forth in claim 2 wherein the counter includes a reset button for recalculating the length of dispensed wallpaper from zero.

6. A wallpaper dispenser as set forth in claim 2 wherein the wallpaper roll holder includes a rod pivotally coupled to the housing via a universal joint.

7. A wallpaper dispenser as set forth in claim 2 wherein the wallpaper roll holder includes a rod with a retainer cap removably mounted thereon and further adapted to being rotatably received within the housing.

* * * * *